United States Patent [19]

Krob

[11] 4,243,245

[45] Jan. 6, 1981

[54] SAFETY SKI BINDING

[75] Inventor: Erwin Krob, Vienna, Austria

[73] Assignee: TMC Corporation, Zug, Switzerland

[21] Appl. No.: 1,363

[22] Filed: Jan. 5, 1979

[30] Foreign Application Priority Data

Jan. 5, 1978 [AT] Austria ..... 73/78

[51] Int. Cl.[3] ..... A63C 9/08

[52] U.S. Cl. ..... 280/626

[58] Field of Search ..... 280/626, 631, 632

[56] References Cited

U.S. PATENT DOCUMENTS

| | | | |
|---|---|---|---|
| 3,325,178 | 6/1967 | Reuge et al. | 280/626 |
| 3,933,363 | 1/1976 | Schweizer et al. | 280/626 |
| 4,111,453 | 9/1978 | Krob | 280/626 |

*Primary Examiner*—Stanley H. Tollberg

*Attorney, Agent, or Firm*—Blanchard, Flynn, Thiel, Boutell & Tanis

[57] ABSTRACT

A safety ski binding having a sole holder pivotally secured to a base member. The sole holder is held in condition of use by a locking member, which locking member is engaged by a locking part. The locking part is urged into engagement with the locking member by a spring. The locking part is guided in a limited manner in a guideway provided on a support part, which support part is pivotally secured to the base. The support part carries the spring which controls the force necessary to effect a release of the binding. A release lever is pivotally secured to the housing by means of two axially spaced and separate axles. A bolt, which extends transversely with respect to the longitudinal axis of the ski, is provided for blocking the free upward travel of the housing when the release lever is in the normal position of use for facilitating downhill skiing. A movement of the release lever to the release position will permit the housing to freely move relative to the bolt.

19 Claims, 21 Drawing Figures

SAFETY SKI BINDING

The invention relates to a safety ski binding similar to U.S. Pat. No. 3,933,363 and comprises a sole or heel holder which is pivotal with respect to a ski-fixed base part and which is held in the downhill skiing position by a lock pawl which has a notch into which is received a locking part loaded by a spring and which is thus at least a part of a spring abutment and which is movably supported through a limited range in a guideway of a support part pivotally supported about an axle which is secured on the base part and on which the release lever is hinged, and the lock pawl is associated with one side thereof with a locking nose and has the notch on the other side.

BACKGROUND OF THE INVENTION

Such ski bindings are already known from (U.S. Pat. Nos. RE 26,670 and U.S. Pat. No. 3,933,363) and have proven to be successful in practice. Here the locking springs acts always onto the sole holder. Upon operation of the release lever, the lock pawl is freed entirely, however, the release lever itself remains under the influence of the spring and thus also the sole holder.

In a different known binding, a lock pawl grips with one side over a locking bolt of the pivotal sold holder part and has on the other side a cam plate. A spring-loaded locking part engages the cam plate and is arranged in a pivotal release lever together with the loading spring. If the release lever is pressed downwardly, then the locking part moves along the cam plate into a final position. The lever arm, with which the locking part acts onto the lock pawl, is reduced through this, so that the lock pawl must overcome the effective spring force during a pivoting thereof. However, here too both the lock pawl and also the sole-holding part are always under the influence of the spring.

Furthermore a ski binding is known, in which also a pivotal one side of a lock pawl cooperates with a pivotal sole-holding part and the other side forms a cam plate, along which the spring-loaded locking part can be moved by means of a release lever. The cam plate extends to the pivot axle of the lock pawl, so that upon a movement of the locking part to this area, the line of force of the loading spring extends through the pivot axle of the lock pawl. As a result, the effective force of the spring onto the lock pawl is mostly overcome, so that the lock pawl can be pivoted with a relatively small amount of force. However, a force, even though a very small force, still acts onto the lock pawl and also onto the sole holder. Furthermore the release lever must be pressed constantly, if these conditions are supposed to be met. If the release lever is no longer loaded, then the locking member moves automatically into the locking position and during a pivoting of the sole holder, the entire spring force must be overcome by the use of the lock pawl.

The basic purpose of the invention is now to provide a safety ski binding of the above-mentioned type such that the arbitrary release can take place only against the force of a relatively small spring force.

The great advantage of the invention which is the subject matter of the application compared with already known bindings having a control cam and a locking part consists in it being no longer necessary, during an arbitrary opening of the inventive binding, for example by means of pressure or pull by the use of a ski pole, to compress the entire work-spring package, but in having to overcome during the operation of the release lever only the force of a spring, the force of which one can freely choose, for resisting this movement. Accordingly, one will choose a spring having a small spring force. In particular, the force of this spring is substantially smaller than the one of the main spring (release or locking spring).

BRIEF DESCRIPTION OF THE DRAWINGS

Further details, advantages and characteristics of the invention will now be described more in detail with reference to the drawings, which illustrate several exemplary embodiments.

In the drawings:

FIGS. 1 and 1*a* are related views of a heel binding embodying the invention, wherein FIG. 1 is a central cross sectional view taken along the line I—I of FIG. 1*a* and FIG. 1*a* is a bottom view of FIG. 1;

Furthermore

DETAILED DESCRIPTION

In the exemplary embodiment according to FIGS. 1 to 4, a heel binding is arranged on a not illustrated ski in a conventional manner by the use of a ski-fixed mounting member. The mounting member has a guide rail which is not identified in detail and in which a base member or bearing block 1 is movable relative to and along the longitudinal axis of the ski and can be locked in selected positions and held in the guide rail so that it cannot be lifted therefrom. The bearing block 1 consists of a bottom wall 1*a* which functions as a guide plate, side walls 1*b* and a front wall 1*c* which has a locking nose or projection construction 1*d* therein. In each of the two rear ends of the side walls 1*b*, which extend upwardly substantially perpendicularly to the bottom wall 1*a*, remote from the tip of the ski, there is provided an opening 1*e* therein axially aligned with each other. The front wall 1*c* extends along an arc, the radius of which lies on a line which connects the center points of the two axially aligned openings 1*e*, and has on its side which faces away from the bottom wall 1*a* a stop 1*f* at the upper rim thereof. The upper edges of each of the two side walls 1*b* extend downwardly from the upper rim of the front wall 1*c*, first briefly, then transfers into a rim part which extends parallel to the upper surface of the ski, and then subsequently into an upwardly opening parabolically shaped curve terminating at the rear end of each thereof and the bottom wall 1*a*.

Figure 1:
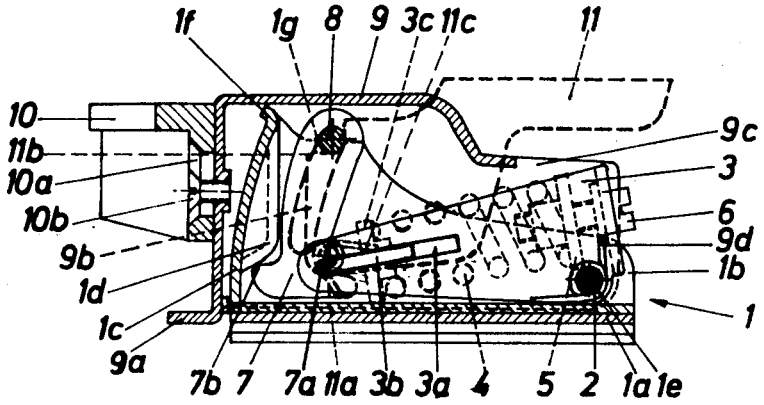
Figure 1A:
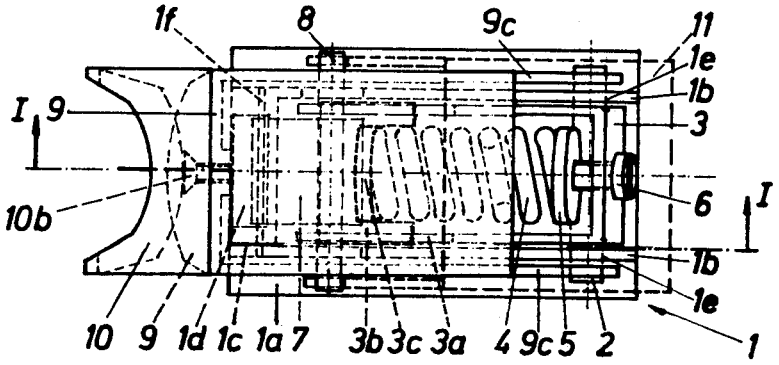

The two side walls 1*b* each have in their two rim parts which are parallel with respect to the upper surface of the ski one semicircular indentation or notch 1*g* having a radius which will be described in more detail below. A pivot axle 2 which is received and supported in the openings 1*e* extends substantially at a right angle with respect to the longitudinal axis of the ski and through the two side walls 1*b* of the bearing block. The support part 3 is constructed approximately U-shaped in a top view and has one longitudinal slot 3*a* in each side wall thereof (not identified in detail), which forms a guideway for a locking part 3*b* which is substantially U-shaped in a top view (compare FIG. 1*a*). A spring abutment 3*c* is provided in the free space of the locking part 3*b* (in the U), against which engages one end of a locking spring 4. The other end of the locking spring 4 engages a spring abutment 5, which can be adjusted in axial direction of the spring 4 by means of a screw 6 which is rotatably supported in the support part 3.

The locking part 3*b* loads at its end which faces the front wall 1*c* of the bearing block 1 an approximately inverted T-shaped locking member 7. The lower end of the locking member 7 extends rearwardly to define a notch or recess 7*a* and frontwardly to define a lock pawl or projection 7*b*. The locking member 7 is pivotally supported on a bolt 8, which has a sufficient length so that the ends thereof are received in the two axially spaced semi-circular indentations 1*g* in the side walls 1*b* of the bearing block 1 and is held in this position by the locking member 7. This is achieved by the locking member 7, loaded by the pressure of the locking spring 4, gripping through its lock pawl 7*b* under the locking nose 1*d* on the rearwardly facing surface of the front wall 1*c*.

A housing 9 which substantially overlies the previously mentioned structural parts is also pivotally supported through a limited range about the pivot axle 2. A stepping spur 9*a* and a sole holder 10 are provided at the front end of the housing 9 remote from the pivot axle 2. The sole holder 10 has a slotted hole 10*a* therein which extends vertically and is connected to the housing 9 by means of a countersunk or flathead screw 10*b*. The housing 9 has a slotted hole 9*b* on each side wall 9*c*, the center axes of which slotted holes are concentrical with respect to the central axis of the pivot axle 2.

A release lever 11 is pivotally supported on the side walls 9*c* of the housing 9 by means of two axially aligned and separate axles 11*a*. The release lever 11 has two laterally spaced locking steps 11*b* located above the axis of the axles 11*a*. The locking steps 11*b* are positioned in the downhill skiing position of use approximately vertically above the axles 11*a*. The release lever 11 is held in the normal position of use by a torsion spring 11*c* which encircles the axles 11*a* and are supported so that one arm thereof engages the release lever 11 and the other arm engages a part 1*a* of the housing 9, in the downhill skiing position. The two locking steps 11*b* on the release lever extend beneath the bolt 8 which lies in the semicircular indentations 1*g* of the bearing block 1 and prevents a pivoting of the housing 9 about the pivot axle 2, which housing 9 is also biassed in clockwise direction by a torsion spring 9*d*.

Figure 2:
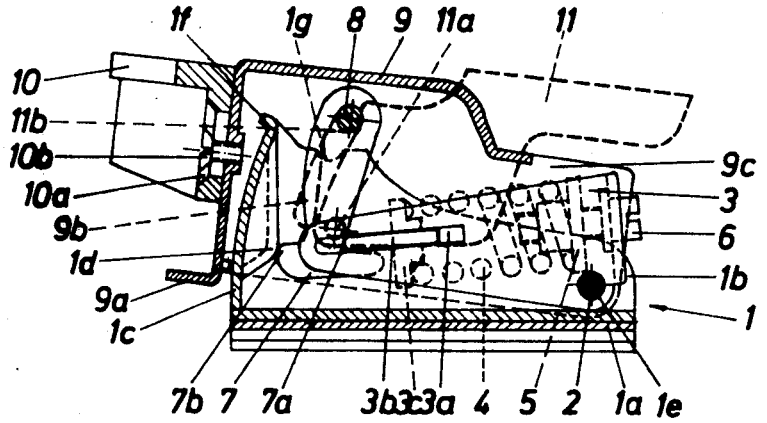
FIG. 2 illustrates the binding in a position during a safety release according to FIG. 1.

Upon occurrence of an overload, for example during a fall, a safety release will take place as is shown in FIG. 2. The housing 9 is pivoted about the pivot axle 2 in the clockwise direction. Since the release lever 11 is connected by means of the two spaced axles 11*a* to the housing 9 and thus must partake in the pivoting movement of the housing 9, the bolt 8, on which the locking member 7 is supported, is moved along therewith. The lock pawl 7*b* is thereby moved with the locking nose 1*d* of the bearing block 1 and it presses the locking part 3*b* back against the force of the locking spring 4 in the two laterally spaced longitudinal slots 3*a*. Thus upon a movement of the housing 9, the support part 3 is also pivoted in the same manner about the pivot axle 2, so that the lock pawl 7*b* remains under the action of the locking spring 4 due to the locking part 3*b*. FIG. 2 illustrates the moment of the release. From this point on, the locking spring 4 can again relax slightly since the lock pawl 7*b* of the locking member 7, when it slides along the vertical rearwardly facing part of the locking nose 1*d*, can swing back again slightly. The binding remains then, under the effect of the torsion spring 9*d* on the housing 9, in the open position and is practically ready for the skier to step thereinto. As soon as the housing 9 is pressed downwardly due to the applied force on the spur 9*a* by a ski boot (not shown), the lock pawl 7*b* of the locking member 7 grips under the pressure of the locking spring 4 again under the downwardly facing surface of the locking nose 1*d* and the binding again assumes the position of use according to FIG. 1.

The release lever 11 must be pressed down against the force of the two torsion springs 11*c* which are arranged on the spaced axles 11*a* during an arbitrary release of the binding. As a result, the release lever 11 is pivoted clockwise about the spaced axles 11*a* so that the bolt 8 is no longer gripped in the locking step 11*b*. This makes it now possible for the housing 9 which is biassed by the torsion spring 9*d* to pivot upwardly about the pivot axle 2. Since, in spite of this movement the lock pawl 7*b* continues to extend beneath the locking nose 1*d* and thus no regular movement of these structural parts occurs, the bolt 8 is also held in the semicircular indentations 1*g* and the pivoting movement of the housing 9 is made possible only by a sliding of the housing relative to the bolt 8 in the two slotted holes 9*b* in the sidewalls of the housing 9.

This arrangement of the release mechanism makes it possible to facilitate an arbitrary opening of the binding by applying only such force as is needed to overcome the force of the torsion springs 11*c* which act on the release lever 11. It is not necessary to compress, as has been done up to now during an arbitrary opening, the entire work-spring package. The spring force which must be overcome during opening is constant and it can be chosen independent from the strength of the locking spring 4.

The binding remains, after the release lever 11 has been pressed down and it thus opens up, in the open position due to the (third) spring 9*d* which biasses the housing and is ready for the skier to step therein practically after each opening. Through an additional locking of the release lever 11 in the pressed-down position (cross-country position), as is illustrated in FIG. 3, the binding can be used as a walking aid and has at the same time, due to the locking nose 1*d*, a soft stop in the final position and a safety release.

Figure 3:
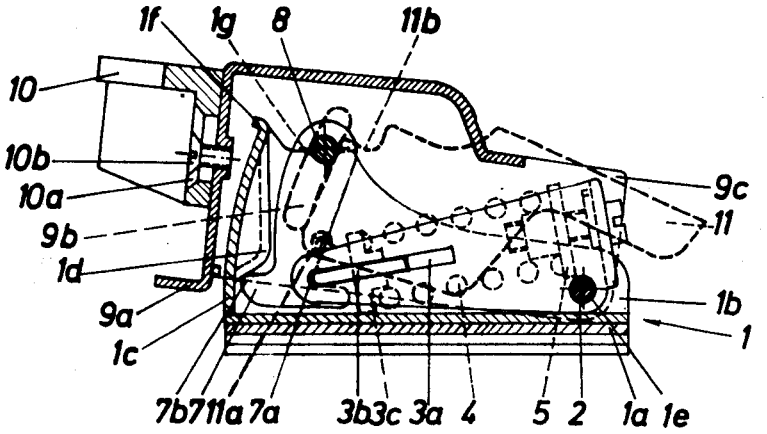
FIG. 3 illustrates the release position of the binding following an operation of the release lever also according to FIG. 1.
Figure 4:
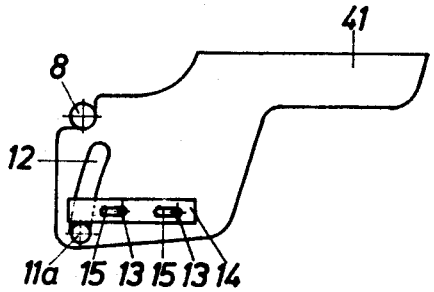
FIGS. 4 to 20 illustrate various embodiments of the release lever and of the locking mechanism.
Figure 5:
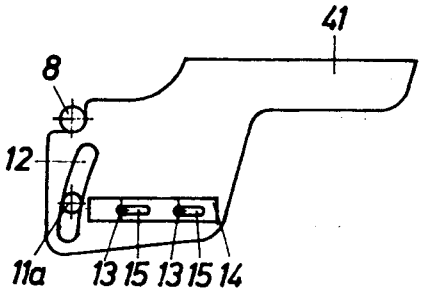

The release lever 41 is in FIGS. 4 and 5 constructed identical to the release lever 11 according to FIGS. 1 to 3 but for one slot 12 which is arranged on each side and is curved concentrically with its center concentric with the pivot axle 2 (not shown here). Furthermore, two pins 13 are each supported on both sides of the release lever 41 and are used to guide a slide member 14 which is provided with longitudinal slots 15 thereon for longitudinal movement. The slide member 14 is moved forwardly in the downhill skiing position (FIG. 4) and the associated spaced axles 11*a* are located under the slide member 14, so that it is locked and cannot slide upwardly in the slots 12. When the slide member 14 is slid rearwardly (FIG. 5 cross-country skiing position), a sliding of the spaced axles 11*a* in the slots 12 is possible and permits a pivoting of the housing 9 (not shown here). The length of the slot 12 determines the amount of pivoting of the housing 9 and the sole holder 10, which amount, in relationship to the heel of the ski boot, determines the length of movement of the binding.

Figure 6:
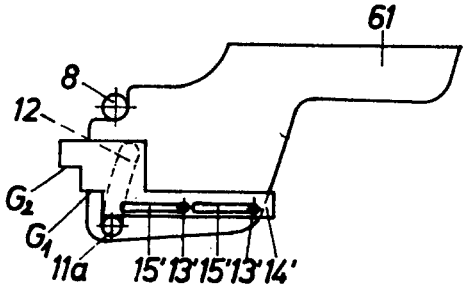
Figure 7:
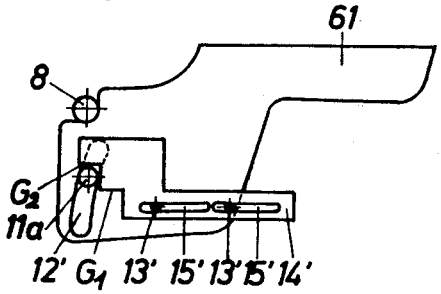
Figure 8:
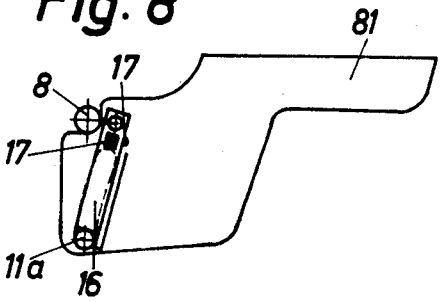
Figure 9:
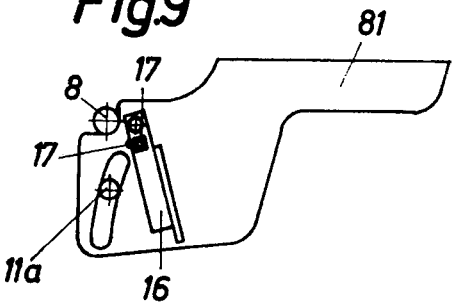

FIGS. 6 and 7 show the principle according to FIGS. 4 and 5 with a modified release lever construction 61. The slide member 14 has a plurality of steps thereon so that one can adjust several, in the present example, two additional heights of lift ($G_1$, $G_2$). FIG. 6 illustrates the locked downhill skiing position and in FIG. 7 the spaced axles 11*a* are shifted to the lift position $G_2$. The $G_2$ position assures a damped or cushioned stop, the $G_1$ position a safety release. FIGS. 8 and 9 illustrate the release lever 81, in which the locking of the bolt 8 is achieved through the use of a pivotally supported lever 16, which is held by means of spring-loaded balls 17 either in the locked position (downhill skiing position), as illustrated in FIG. 8, or according to FIG. 9 in the open position (cross-country skiing position).

Figure 10:
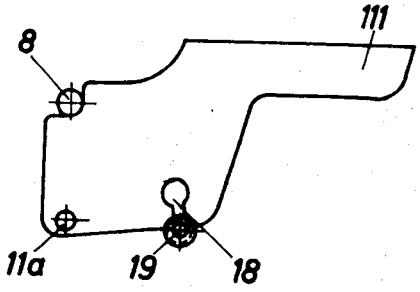
Figure 11:
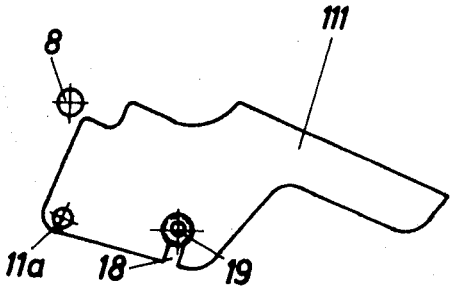

The release lever 111 in FIGS. 10 and 11 is identical to the embodiment according to FIGS. 1 to 3, but for a recess 18 in one of the side walls of the lever. The release lever 111 is held in this exemplary embodiment in a released position by means of a knurled-head screw 19, with which the binding is in a cross-country skiing position. The recess 18 is designed such that it permits the release lever 111 to carry out a pivoting movement about the spaced axles 11*a*.

Figure 12:
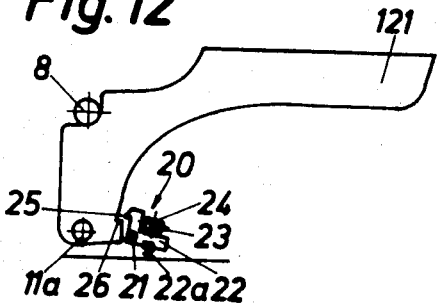
Figure 13:
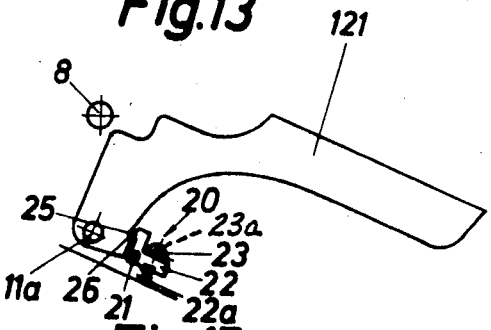

The structure of the release lever 121 is shown in FIGS. 12 and 13. A structural part which as a whole is identified as a fixing hook 20 is pivotally supported on the housing 9 for limited movement by means of a hinge pin 21. The fixing hook 20 has a lever arm 22 and a locking hook 25, which lever arm is biassed by a spring 22*a* which is supported on the bottom plate 1*a*. A cylindrical part 23 which is rotatable about its own axis acts furthermore onto the upper side of the lever arm 22, which cylindrical part 23 has a circular-segmental flattened portion 24 which extends in longitudinal direction. The cylindrical part 23 is rotatably supported about a horizontal axis spaced above the upper side of the lever arm 22 and in the housing 9. The cylindrical part 23, in the position wherein its flattened part 24 is remote from the lever are 22 (FIG. 12, downhill skiing position), effects a pivoting of the fixing part 20 in a clockwise direction against the force of the spring 22. The cylindrical part 23 has for this purpose a slot 23*a*, into which one can insert a screw driver, a coin or the like. As a result, the desired position of the part 23 can be adjusted (FIG. 12 or FIG. 13). The mentioned pivoting of the part 23 is just so large that the locking hook 25 is pivoted rearwardly so that it cannot engage the associated counterpiece 26 of the release lever 121. FIG. 13 illustrates the binding in the cross-country skiing position. The cylindrical part 23 has in this position been rotated so that its flattened portion 24 faces the upper side of the lever arm 22 and the release lever 121 is subsequently pressed down against the force of the not illustrated torsion spring. This operation is now possible, because the smaller distance between the upper side of the lever arm 22 and the center line of the cylindrical part 23 becomes effective. Thus the locking hook 25 engages the counterpiece 26 and holds the release lever 121 in the pressed-down or in the release position and permits therewith the sold holder (not shown) to perform a release movement (cross-country skiing position) until the cylindrical part 23 is again rotated for 180° and is thus moved into the position according to FIG. 12. The fixing hook 25 becomes disengaged from the counterpiece 26 and the spring-loaded release lever 121 is again pivoted into the downhill skiing position (according to FIG. 12).

Figure 14:
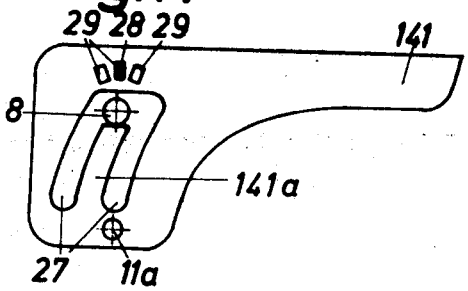

In the exemplary embodiment according to FIG. 14, it is possible to release the binding arbitrarily, either by pressing or by pulling on the release lever 141. In order to make this possible, the release lever 141 has two curved slotted holes 27 therein which are interconnected at their upper ends. The curvature of each of the slotted holes 27 extends along an arc having difficult radii, the centerpoints of which are coaxial with the pivot axle 2. If the release lever 141 is now pressed down, then it pivots about the spaced axles 11*a* and a spring-loaded ball 28 engages the left one of the notch openings 29. The release lever 141 can now carry out a pivoting movement with the housing (not illustrated), because it is not prevented from doing so by the bolt 8, which can slide in the leftmost slotted hole 27, the radius of which is concentric with respect to the pivot axle 2 (not shown here). If the release lever 141 is operated by pulling upwardly thereon, then the spring-loaded ball 28 locks into the rightmost one of the notch openings 29 and the bolt 8 slides in the rightmost slotted hole 27. The ball 28 is for the downhill skiing position locked in the center notch opening 29 and the release lever 141 cannot perform a movement to the released position due to the provision of a support part 141*a* which is located between the two slotted holes 27 and is aligned with the bolt 8.

Figure 15:
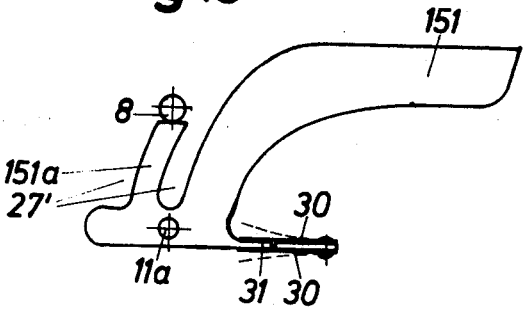

The release lever 151, which is constructed corresponding to the embodiment according to FIG. 14, can according to FIG. 15 also be pivoted in both directions. The two slotted holes 27 are in this exemplary embodiment "open" and in the downhill skiing position the release lever is supported through the support part 151*a* on the bolt 8. The release lever 151 is repeatedly returned into the downhill skiing position by two ski-fixedly arranged leaf springs 30, which engage the bottom and the upper surfaces of a flange 31 on the release lever.

Figure 16:
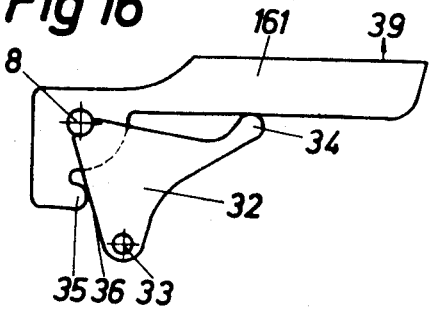
Figure 17:
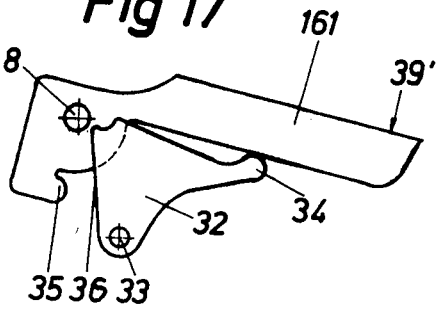

In the embodiment according to FIGS. 16 and 17, a release lever 161 which can be operated in both directions is used to pivot a holding part 32, which is repeatedly urged frontwardly to the downhill skiing position (FIG. 16) by spring force applied by a not illustrated torsional spring force about the axle 33, into a position which is disengaged from the bolt 8. This is done either by pressing the release lever 161, as shown in FIG. 17, down and pressing thereby onto an arm 34 of the holding part 32 and thus pivoting this part 32 in the clockwise direction about the axle 33, or by pulling on the release lever 161 in direction of the arrow 39 (FIG. 16), whereby a nose 35 on the release lever 161 acts onto a sliding surface 36 of the holding part 32 and pivots same clockwise about the axle 33. The holding part 32 is engaged with the bolt 8 in FIG. 16; the holding part 32 is disengaged from the bolt 8 in FIG. 17.

Figure 18:
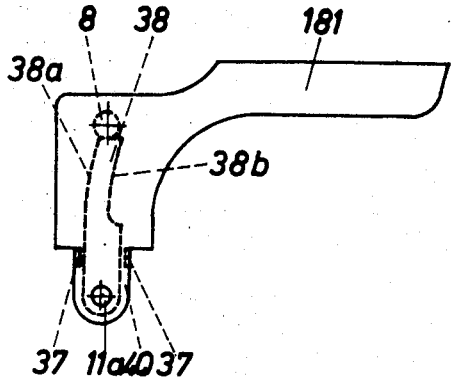
Figure 19:
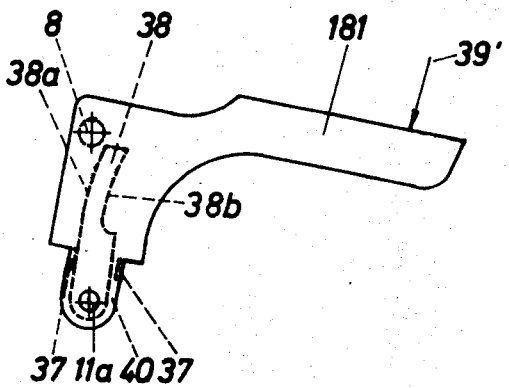
Figure 20:
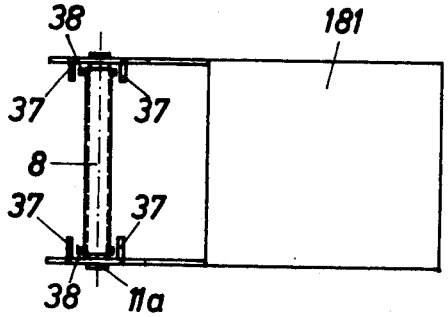

The exemplary embodiment according to FIG. 18 to 20 illustrates also a release lever 181 which can be operated in both directions. It is pivotally supported on the housing 9 (not shown here) by means of spaced axles 11*a*. The release lever 181, as is illustrated in FIG. 18, is held in the downhill position of use with the aid of a torsion spring (which is also not illustrated). The release lever 181 has a pair of laterally spaced tapered portions 40 in the region of the spaced axles 11*a*. Two oppositely positioned operating plates 37 which extend in direction toward the bolt 8 are provided adjacent the end of the tapered portion 40 on each side of the release lever 181, which plates 37 are bent at a right angle in direction toward the center of the binding (compare FIG. 20).

A support part 38 is pivotally supported on each of the spaced axles 11*a* on each side of the release lever 181 and between the portions 40. The support parts 38 are dimensioned such that, in the area of the operating plates 37, between it and the individual operating plates 37, there remains a gap in the downhill skiing position (FIGS. 18 and 20). The support part 38 extends upwardly to engage the bolt 8 in this position. The upper half of the support part 38, which half is associated with the bolt 8, has two different curvatures 38*a*, 38*b*. The curvature 38*a*, which is on the forward or left side viewed from an observer, is concentric with respect to the pivot axle 2 during a pivoting operation which will yet be described more in detail. The curvature 38*b*, which is on the rear or right side viewed from an observer, is concentric with respect to the pivot axle 2 during a pivoting operation which will yet be described more in detail. Furthermore the release lever 181 is designed such that it encloses in every position both the bolt 8 and also the support part 38. As a result, an overlapping of these structural parts by the release lever 181 defines not only a boundary against a lateral shifting for the bolt 8, but also a danger of injury is banned, which could be created if for example the fixing part would lie on the outside and also the operating plates 37 would extend outwardly.

If now the release lever 181 which can be operated in both directions is pivoted about the spaced axles 11*a* by pressing down or by pulling up thereon, then first a certain angle, which corresponds to a certain, desired idle path, is covered, before the support part 38, loaded through the operating plates 37, disengages from the bolt 8, which results in a pivoting in the clockwise (by pressing down) or in the counterclockwise direction (by pulling up) of the release lever 181. FIG. 19 illustrates a position wherein the release lever 181 is pivoted in the direction of the arrow 39 by pressing down thereon. FIG. 20 is a top view of FIG. 18 and is provided for a better understanding of the structure of the entire release mechanism.

The invention is not limited to the illustrated exemplary embodiments. Further modifications are conceivable, without departing from the scope of the invention. In particular, preferred further developments can be achieved through the combination of two or several of the described examples.

The embodiments of the invention in which an exclusive property or privilege is claimed are defined as follows:

1. In a safety ski binding having a base member having means defining one of a locking projection and recess thereon, sole holder means pivotally supported to said base member for movement about a first pivot axis, support means pivotally supported to said base member for movement about a second pivot axis, said support means including a movable locking part thereon, a locking member and pivotal support means pivotally supporting said locking member on said sole holder means, said locking member having the other of said locking projections and said recess thereon and engaging said one of said locking projection and said recess when said sold holder means is in a position of use, resilient means mounted on and movable with said support means, said resilient means being positioned between and engaging said support means and said locking part to resiliently urge said locking part into engagement with said locking member so that said locking member is also urged by said resilient means into engagement with said one of said locking projection and said recess, one of said locking projection and said recess being maintained in engagement with said other of said locking projection and said recess by the force of said resilient means, and release lever means pivotally supported on said sole holder means for movement between first and second limit positions about a third pivot axis, the improvement comprising wherein said release lever means includes a locking step means, wherein said sole holder means includes means defining an elongated and arcuate slot having a radius whose center is coincident with said first pivot axis, wherein said pivotal support means includes an elongated bolt extending transversely with aspect to the longitudinal axis of said ski and pivotally supporting said locking member, the lateral ends of said bolt being slidingly received in said elongated and arcuate slot means, said locking step means blocking a sliding of said bolt in said slot means when said release lever means is at said first limit to restrict the pivotal movement of said sole holder means so that it will be against the urging of said resilient means and wherein yieldable means are provided for yieldably holding said release lever means at said first limit position, whereby a movement of said release lever means to said second limit will remove said locking step means from a blocking relationship with said bolt so that said bolt will slide in said slot means and said sole holder means will be freely pivotal about said first pivot axis.

2. A safety ski binding according to claim 1, wherein said first and second pivot axes are one and the same pivot axis.

3. The safety ski binding according to claim 1, wherein said yieldable means is a torsion spring mounted on said third pivot axis, one arm of said torsion spring engaging said release lever and the other arm engaging said sole holder means.

4. The safety ski binding according to claim 1 or 3, wherein said base member includes indentations for receiving said bolt therein to limit the movement of said bolt in said slot in said release lever means in a first direction, one end of said slot in said release lever means limiting movement of said bolt in a second direction opposite to said first direction.

5. The safety ski binding according to claim 1, wherein said third pivot axis is comprised of a pair of spaced axles secured to opposite sides of said release lever means.

6. The safety ski binding according to claim 5, wherein said release lever means has a pair of curved slots concentric with said first pivot axis, in which said slots said two spaced axles of said release lever means are movably received and including a movable slide member for blocking movement of said axles relative to said release lever means.

7. The safety ski binding according to claim 6, wherein said slide member is held and guided on a pair of pins which are provided on at least one side of said release lever, said slide member having longitudinally extending slots therein, each receiving one of said pair of pins therein.

8. The safety ski binding according to claim 6, wherein said slide member has at least two surfaces representing additional heights of lift for the position of said spaced axles, said slide member being adjustable longitudinally to facilitate a variance of the degree of relative movement of said sole holder means to thereby regulate the walking capability (cross-country skiing) thereof.

9. The safety ski binding according to claim 6, wherein said slide member is a lever which is pivotally arranged on at least one side of said release lever and wherein said yieldable means comprises spring-loaded balls for holding said lever in each of said first and second limit positions.

10. The safety ski binding according to claim 1, wherein said yieldable means includes a recess in said release lever means in which is received in one of said first and second limit positions a knurled-head screw.

11. The safety ski binding according to claim 1, wherein said yieldable means includes a fixed hook pivotally supported through a limited range on said sole holder means about a hinge pin which extends transversely with respect to the longitudinal axis of said ski, and in said first limit position said fixing hook engages a counterpiece on said release lever means.

12. The safety ski binding according to claim 11, wherein said fixing hook which is supported on said hinge pin is in a side view substantially a two-arm toggle lever, one arm of which carries a locking hook and the other arm of which is engaged by a spring, said arms being on opposite sides of said hinge pin, said yieldable means further including a cylindrical part which is rotatable about its own axis and has a circular-segmental flattened portion thereon which is provided about the upper side of said other arm, wherein the cylindrical part is rotatable to the position wherein its flattened portion faces away from said other arm and said fixing hook is moved against the force of said spring to effect a holding of said locking hook in a position disengaged from said counterpiece on said release lever means.

13. The safety ski binding according to claim 11, wherein said cylindrical part has at one of its ends a slot for operatively receiving a tool and in the position in which its flattened portion is rotated to face said other arm, said release lever means engages through its counterpiece said locking hook to effect a holding of said release lever means in one of said first and second limit positions.

14. The safety ski binding according to claim 1, wherein said release lever means has curved slotted holes therein which extend substantially parallel to one another and are separated by a support part, said support part supporting said bolt in one of said first and second limit positions of said release lever means.

15. The safety ski binding according to claim 14, wherein said yieldable means includes for both said support part and also each slotted hole a notch opening, into which can be selectively received a spring-loaded ball to lockingly fix the chosen position of said release lever means.

16. The safety ski binding according to claim 14, wherein said release lever means has a flange engaged by two ski-fixedly arranged leaf springs, said leaf springs effecting an automatic return of said release lever means to one of said first and second limit positions.

17. The safety ski binding according to claim 1, wherein said release lever means is a two-arm lever pivotally supported directly on said bolt, and wherein said yieldable means includes a holding part pivotally supported about a further axis extending transversely with respect to the longitudinal axis of the ski and engaging said bolt to hold said release lever means in one of said first and second limit positions, said holding part having an arm on which is supported an operating arm of said release lever means, and wherein said release lever means has on its other arm a nose, which acts onto a sliding surface on said holding part, and wherein said holding part, both during a pulling up on said operating arm and also through a pressing down onto said operating arm, can be pivoted to become disengaged from said bolt.

18. The safety ski binding according to claim 1, wherein said release lever means has a pair of laterally spaced tapered sections, at the ends of which are provided oppositely positioned operating plates, said plates being bent at a right angle in direction toward the center of said ski binding and are arranged spaced from a center support part, on which said bolt is supported in one of said first and second limit positions.

19. The safety ski binding according to claim 18, wherein said support part is provided with two different curvatures, which are constructed corresponding with the pivoting of said release lever means in a clockwise or a counterclockwise direction.

* * * * *